United States Patent [19]

Bricco

[11] 4,433,843

[45] Feb. 28, 1984

[54] MULTI-PLY PAPER TARGET

[75] Inventor: Larry J. Bricco, Neenah, Wis.

[73] Assignee: Laminations Corporation, Neenah, Wis.

[21] Appl. No.: 305,191

[22] Filed: Sep. 24, 1981

[51] Int. Cl.[3] ..... F41J 1/08; F41J 1/10

[52] U.S. Cl. ..... 273/407; 248/165; 248/432; 248/174; 273/408

[58] Field of Search ..... 273/407, 404, 408, 403, 273/410; 40/610, 124.4; 248/165, 164, 174, 432

[56] References Cited

U.S. PATENT DOCUMENTS

| | | | |
|---|---|---|---|
| 271,647 | 2/1883 | Medart . | |
| 2,720,253 | 10/1955 | Turner et al. | 248/174 X |
| 2,812,947 | 11/1957 | Fatzinger | 273/404 |
| 2,828,565 | 4/1958 | Goldstein | 40/610 X |
| 3,341,162 | 9/1967 | Rochlis | 248/174 |
| 3,367,660 | 2/1968 | DiMaggio . | |
| 3,371,963 | 3/1968 | Weller . | |
| 3,512,778 | 11/1970 | Allen | 273/403 |
| 4,076,246 | 2/1978 | Meyer . | |
| 4,121,959 | 10/1978 | Meyer . | |
| 4,126,501 | 11/1978 | Croll . | |
| 4,334,423 | 6/1982 | Rainis et al. | 273/403 X |

FOREIGN PATENT DOCUMENTS

| | | | |
|---|---|---|---|
| 2932778 | 3/1981 | Fed. Rep. of Germany . | |
| 786525 | 6/1935 | France | 273/407 |
| 20179 | 3/1900 | Switzerland | 273/407 |
| 129327 | 12/1928 | Switzerland | 273/407 |

OTHER PUBLICATIONS

American Rifleman 6-1967, p. 97.
Stanley Hips Broadhead Target 10-1979.

*Primary Examiner*—Paul E. Shapiro
*Attorney, Agent, or Firm*—Andrus, Sceales, Starke & Sawall

[57] ABSTRACT

A target and supporting structure therefore are formed of a multiplicity of substantially coplanar plies of paper adhesively bonded together into a non-hattering and non-splintering rigid laminate. The target may be fixedly supported by a frame structure or removably supported in a free standing position by a slotted base. A method of making and assembling the target and supporting structure therefore is also disclosed.

31 Claims, 11 Drawing Figures

FIG. 5
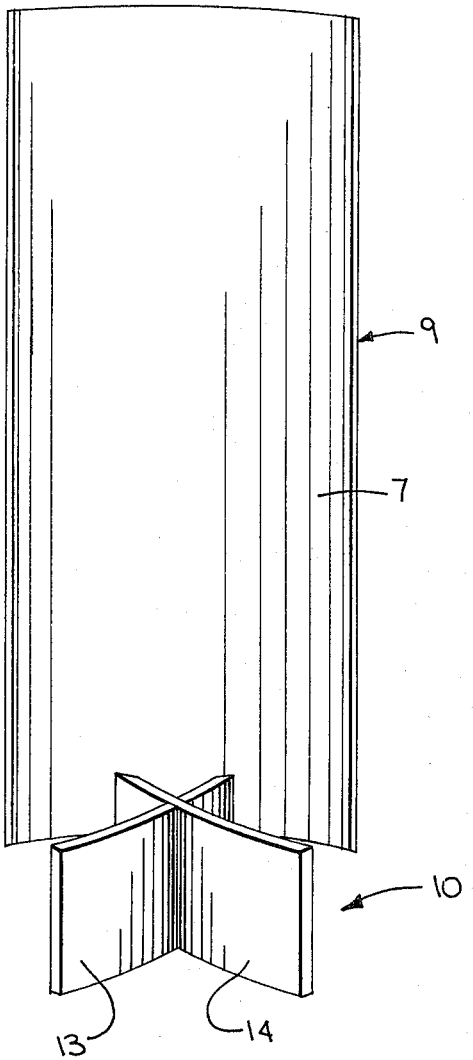
FIG. 6
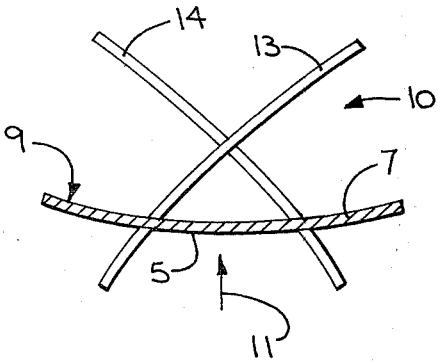
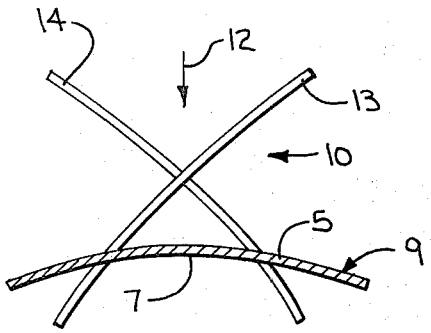
FIG. 7
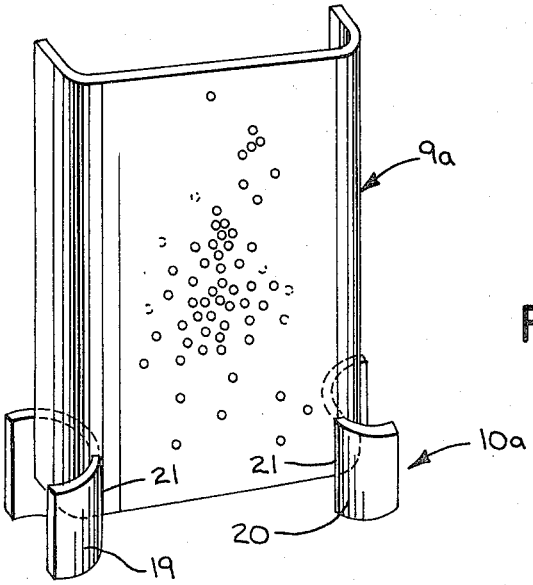
FIG. 8

MULTI-PLY PAPER TARGET

CROSS REFERENCE TO RELATED APPLICATIONS

A portion of the disclosure in this application is also disclosed and/or claimed in the following concurrently filed applications:

Ser. No. 06/305,190, filed Sept. 24, 1981 in the name of John V. Maring and Larry J. Bricco and entitled "Stacked Paper Target", now abandoned and Ser. No. 06/305,189, filed Sept. 24, 1981 in the name of Richard B. Angwin and entitled "Bullet Trap".

BACKGROUND OF THE INVENTION

The present invention relates to targets, and more particularly to a target material composed of multiple plies of paper adhesively bonded together into a laminate construction.

In the past, targets have been constructed of a variety of materials and have been manufactured in various manners. For example, Medart, U.S. Pat. No. 271,647, shows a tiltable javelin target utilizing a plurality of movable pins on the target surface. Croll, U.S. Pat. No. 4,126,501, shows a method of making an archery target from a plastic film web. Meyer, U.S. Pat. No. 4,121,959, discloses an archery target formed of webs of resilient porous resin material together with webs of resin sheeting secured together in a laminate construction. Thus, a variety of target materials have been used in the past for a variety of different weapons.

One of the most common bullet targets currently in use is formed of a flat sheet of plywood or pressed wood mounted on a supporting structure. The target generally includes a defined hit area marked with concentric circles or other target indicia, or may be cut in the form of a silhouette profiling an animal or human being. The supporting structure is also generally made of plywood, pressed wood, or metal. Targets and their supporting structures built of wood or metal in this manner are bulky, heavy and awkward to package and ship. Wood targets and frames have a further problem of shattering or splintering upon impact by a bullet and thus have a short life. In addition, metal supporting frames may ricochet bullets that miss the hit area of the target and thus the use of metal presents a safety hazard.

SUMMARY OF THE INVENTION

A target includes a multiplicity of plies of paper adhesively bonded together into a rigid laminate construction. The laminate construction provides a non-shattering and non-splintering target material which will not ricochet a bullet.

Each paper ply preferably consists of a continuous paper web of recycled chipboard having a thickness of from about 0.025 inches to about 0.035 inches. The use of recycled paper provides a raw material that has a sufficient density and strength to provide high energy absorption characteristics. The density of the paper material is such that it has sufficient strength to enable it to withstand the tension and compression applied to it during the manufacturing process. In addition, the recycled paper will not shatter or splinter upon impact of a bullet due to its short and tightly packed fibers.

The non-shattering, non-splittering target material is manufactured by convolutely winding a continuous web of paper material into a tubular structure having substantially coplanar successively outwardly extending plies. As the winding proceeds, each ply of paper material is adhesively bonded to one another while at the same time the web of paper is subjected to lengthwise tension and to thicknesswise compression. Once the tubular structure has the desired thickness or number of convolutions the tubular structure is cut into the desired target shape.

In another aspect, a target assembly includes a target and a base for supporting the target in a shooting position. Either the target or the base, or both the target and the base may be composed of multi-ply target material. The target assembly may include a free standing unit, a target mounted on a fixed upstanding frame, or a silhouette mounted on a platform.

The present invention thus provides an improved target material that is non-shattering and non-splintering, and will not ricochet a bullet. Target assemblies built of this material are relatively light in weight, easy to package and ship, and have a relatively long useful life.

Other objects and advantages of the present invention will appear during the course of the following description and claims.

BRIEF DESCRIPTION OF THE DRAWINGS

The drawings illustrate the best mode presently contemplated of carrying out the invention.

In the drawings:

FIG. 5 is a rear view in elevation of the target assembly shown in FIG. 3;

FIG. 6 is a top view of the target assembly shown in FIG. 3;

FIG. 7 is a top view similar to FIG. 6 except showing the position of the target reversed from that of FIG. 6;

FIG. 8 is a front view in elevation showing another form of a free standing target assembly;

DESCRIPTION OF THE PREFERRED EMBODIMENT

Figure 1:
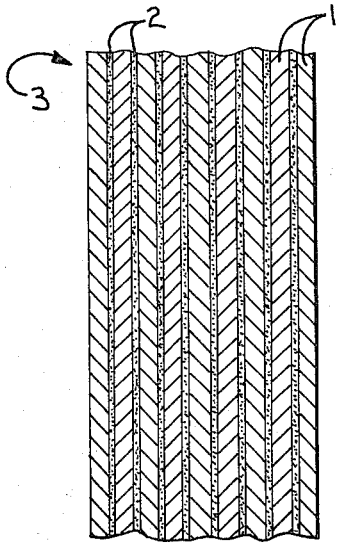
FIG. 1 is a fragmentary view in cross section illustrating the target material of the present invention.

A target member 3 includes a multiplicity of superimposed, substantially coplanar plies 1 of paper material, and a multiplicity of layers 2 of adhesive material interposed between each ply 1. The adhesive layers 2 bond the plies 1 together into a rigid laminate target construction as illustrated in FIG. 1 to form the member 3.

The target member 3 is preferably manufactured by convolutely winding a continuous web of paper material into a multi-ply tubular structure. The tubular structure is constructed by winding a web of paper or paperboard continuously about a rotating mandrel until the desired number of convolutions is built up to form the desired wall thickness for the tube. Generally, the wall thickness ranges from about 0.50 to about 0.75 inches. The web of the paper material is fed to the mandrel in a direction such that the plane of the web is substantially perpendicular to the axis of the mandrel. As the paper web advances towards the mandrel, an adhesive is applied thereto. At the same time, the paper web is subjected to lengthwise tension and to thicknesswise compression so that the plies of paper are bonded together into the rigid laminate construction 3. Once the desired wall thickness is reached, the tubular structure is removed from the mandrel and cut into the desired target shapes.

The mandrel referred to above may be rectangular in cross section so that the tubular structure has opposed pairs of substantially parallel sides intervened by curved or rounded corners, or may be circular, eliptical, oblong, etc. in cross section so that components cut from the tubular structure may be preformed with various desired curvatures and shapes.

In the past, such convolutely wound tubular structures have been used as forms for concrete columns as well as in the manufacture of various furniture parts such as chair backs and seats as shown in Weller, U.S. Pat. No. 3,371,963.

Nevertheless, it has been unexpectedly discovered that a convolutely wound tubular structure composed of a multiplicity of plies of paper material adhesively bonded together into the rigid laminate construction 3 makes an excellent material for bullet targets and supporting structures for such targets. Tubular structures made of convolutely wound paper materials may easily be cut into the various target shapes, and may be preformed with built-in curvatures corresponding to the shape of the mandrel being used. Such a built-in curvature is particularly advantageous for free standing targets used at outdoor shooting ranges, as will hereinafter be described.

Each ply 1 of paper material is preferably comprised of recycled chipboard having a caliper or thickness of from about 0.025 to about 0.035 inches. Also, the moisture content of each ply 1 is preferably from about 3.5% to about 5.5%. The use of recycled paper fibers as the raw material for the plies 1 is particularly advantageous for use in the target member 3 because recycled chipboard has paper fibers that are relatively short and tightly packed. These fibers provide a paper web that has a density of from about 3.0 to about 3.5 lbs. per point of caliper. A paper web having such a range of density, caliper and moisture content is particularly advantageous for use in making a convolutely wound tubular structure since such a moisture content is sufficient to permit the web to absorb the adhesive, and such a density and caliper provides sufficient strength in both the machine direction and cross direction to withstand the tension and compression applied during the winding process. It has been found that a ply 1 of recycled chipboard having a minimum plybond characteristic of about 0.125 lbs. per sq. inch measured by the standard U-block method of testing is adequate for use in the target member 3.

Figure 2:
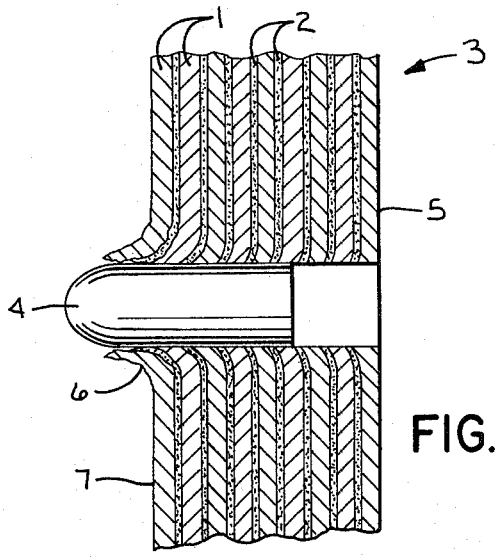
FIG. 2 is a fragmentary view similar to FIG. 1 showing a bullet passing through the target material.

The density, caliper and moisture content of each individual ply 1 is also important in the discovery that such a convolutely wound laminate construction may be used as a target material. Since the fibers are short and tightly packed they provide a paper material which will not shatter or splinter when penetrated by a bullet. As seen in FIG. 2, the target material 3 allows a bullet 4 to cleanly penetrate its front face 5. However, as the bullet exits the target, a cone-shaped portion 6 is formed on its back face 7. This cone-shaped portion 6 is formed due to the tendancy of the paper fibers to adhere to one another since they are short and tightly packed. Thus, as the bullet exits the target, its back face 7 does not splinter or shatter. In contrast, plywood has long and relatively loose fibers and tends to shatter or splinter as the bullet exits its back face. Thus, a target material made of convolutely wound recycled paper plies provides a target which has a relatively longer life than plywood bullet targets.

The following has been determined to be the preferred characteristics of each individual ply 1 of recycled raw material:

Caliper—0.030 inches
Moisture—5.5% maximum
Weight—0.105 lbs. per thousand sq. ft.
Density—3.5 lbs. per point of caliper A "point" as used herein refers to and is equal to 0.001 inches. Therefore, a paper web having a density of 3.5 pounds per point of caliper means that one thousand square feet of paper having a thickness of 0.001 inches would weigh 3.5 pounds.

As shown in FIG. 1, the multiple plies 1 of paper material are bonded together by a multiplicity of layers 2 of adhesive. The adhesive is preferably polyvinyl alcohol, and therefore each ply 1 should preferably contain no more than about 5.5% moisture so that the adhesive may be thoroughly absorbed in the paper. However, the paper plies 1 may be bonded together by any of a wide range of adhesives, and the present invention is not limited to the use of polyvinyl alcohol.

The following data was computed from a laminate structure constructed in accordance with the above principles. The thickness of the sample material was 0.422 inches.

| | |
|---|---|
| Modules of Rupture | |
| Machine Direction | 3197 psi |
| Cross Direction | 2135 psi |
| Staple Holding Power | |
| Edge - Machine Direction | 14.7 lbs |
| Edge - Cross Direction | 18.9 lbs. |
| Surface - Machine Direction | 21.4 lbs. |
| Surface - Cross Direction | 21.6 lbs |
| Bolt Holding Power | 1375 lbs. |
| Tensile Strength | |
| Machine Direction | 1765 lbs./in. |
| Cross Direction | 800 lbs /in. |

The above samples were preconditioned at least 48 hrs. at less than 35% relative humidity and then conditioned at least 72 hours at 50% relative humidity at 23° centigrade prior to testing. The modulus of rupture was computed from center load beam tests and is a determination of the amount of pressure applied to the laminate construction to make it crack. Staple holding power was measured with ⅜ inch by ⅜ inch steel chisel point staples and is a measurement of the amount of force needed to pull out such a staple once embedded into the laminate construction. Bolt holding power is the maximum force required to pull a 0.25 inch bolt and washer through the sample. The tensile strength is a measure of the resistance of the sample to rupture under tension. In other words, tensile strength is a measure of the greatest longitudinal stress the sample could bear without tearing apart.

In other tests the ZDT strength of various unconditioned samples was measured and was found to range from about 66 psi to about 81 psi. The ZDT test is performed by attaching a one inch diameter steel block to either side of the laminate sample being tested. Opposite pulling force is then applied to the blocks and the amount of force required to pull the paper apart is the ZDT strength. This characteristic is sometimes referred to the Z-direction tensile strength and is similar to a U-block ply bond test.

In view of the foregoing tests, a laminate construction made from convolutely wound paper plies adhesively bonded together provides an excellent target member 3 which is non-shattering and non-splintering.

Figure 3:
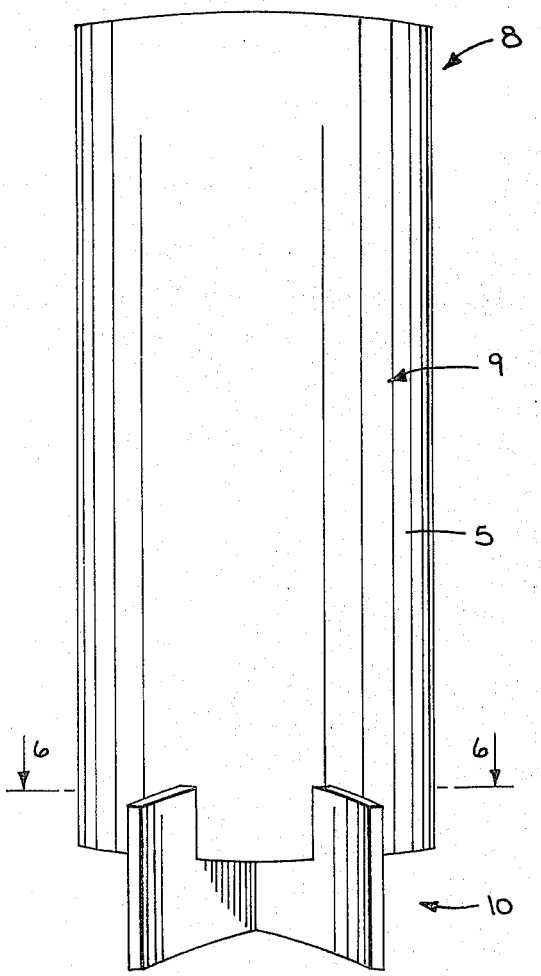
FIG. 3 is a front view in elevation of a target and a cross-shaped base both composed of the target material shown in FIG. 1 illustrating one form of a free standing target assembly.

Referring now to FIG. 3, a free standing target assembly 8 provides a target 9 and a supporting base 10. In the embodiment shown, both the target 9 and base 10 are composed of the laminate target members 3 previously described, although one of such members could be composed of some other material.

As illustrated in FIGS. 6 and 7, the target 9 includes a built-in curvature which is particularly advantageous for use in outdoor shooting ranges. When outdoors, the front convex face 5 of the target 9 faces the wind, which is represented by the direction arrow 11, and the back concave face 7 of target 9 is positioned on the downwind side of target 9. Thus, the built-in curvature of target 9 reduces the effective force of the wind so that it is less likely that the target will be blown over. As shown, target 9 is rectangularly shaped having its length extending vertically from base 10. However, target 9 may also be positioned so that its length extends horizontally with respect to base 10. Further, target 9 may take various other shapes. The target 9 is also adjustable for varying wind conditions. For example, if the wind is blowing in the opposite direction from that shown in FIG. 6, i.e. in the direction represented by direction arrow 12 in FIG. 7, the position of the target 9 may simply be reversed so that its curvature now faces the opposite direction from that shown in FIG. 6. Thus, the front face 5 of target 9 may always be positioned so that it faces the wind to reduce the effective force of the wind. This provides a particularly advantageous arrangement for outdoor target shooting ranges utilizing free-standing target assemblies since the designated shooter positions need not be changed due to varying wind conditions.

Figure 4:
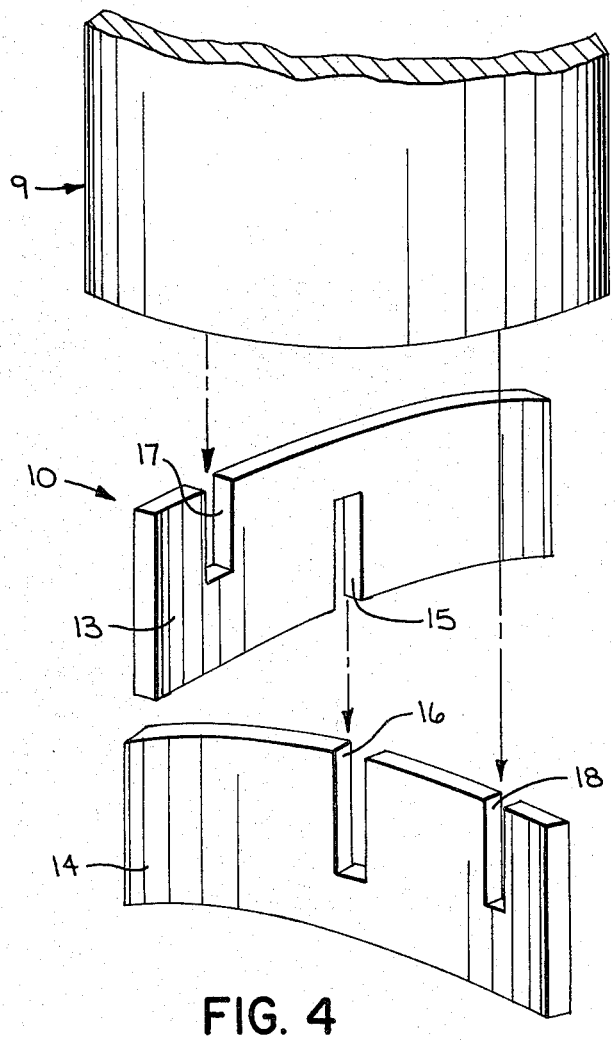
FIG. 4 is an exploded view of the target assembly of FIG. 3 showing the manner of assembling the target and base.

As illustrated in FIG. 4, base 10 includes a pair of legs 13 and 14 arranged to interlock by telescopically engaging one another to form a cross-shaped support for the curved target 9. Leg 13 is provided with a downwardly directed notch 15, and leg 14 includes a corresponding upwardly directed notch 16. The notches 15 and 16 are located at the approximate mid-point of the length of each leg 13 and 14, respectively, and enable the legs 13 and 14 to stand edge wise and interlock with one another to form the cross-shaped support. It should be noted that both legs 13 and 14 are formed with a built-in curvature which helps stabilize the target assembly.

Each leg 13 and 14 also includes an upwardly directed slot 17 and 18, respectively, positioned between the notches 15 and 16 and their forward edges. The slots 17 and 18 retain the curved target 9 in an upstanding position, and are formed so that the curvature of the target 9 may be retained in either direction according to the wind direction. For example, the slots 17 and 18 could be placed toward the marksman so that the oppositely directed legs 13 and 14 are located on the opposite side of the front or target face 5 to provide extra support in case of a high wind being directed toward the target 9, as illustrated in FIG. 6. If the wind is coming from behind the target, the arrangement would be as illustrated in FIG. 7. As previously stated, the rectangular target 9 can be placed lengthwise or widthwise in the supporting legs 13 and 14 to provide a variety of target configurations for the marksman. The notches 15 and 16 and slots 17 and 18 may be positioned at various locations along the length of each leg 13 and 14 as desired.

An alternate free standing target assembly is shown in FIG. 8. As shown therein, the target **9*a* is supported in an upstanding position by means of a base 10*a* that includes a pair of spaced apart legs 19 and 20. Each leg 19 and 20 is designed to stand edgewise, and for this purpose has a preformed curved U-shape as shown in FIG. 8. Each leg 19 and 20 includes an upwardly directed slot 21 for retaining the curved target 9 in an upstanding position. As with the target assembly shown in FIGS. 3–7, either the target 9*a* or legs 19 and 20, or both the target 9*a* and legs 19 and 20 may be composed of a laminate member 3**.

Figure 9:
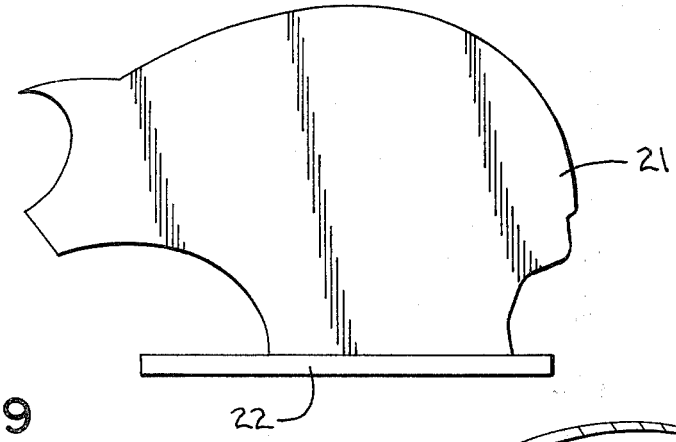
FIG. 9 is a side view in elevation of a target silhouette and platform constituting another form of a target assembly.
Figure 10:
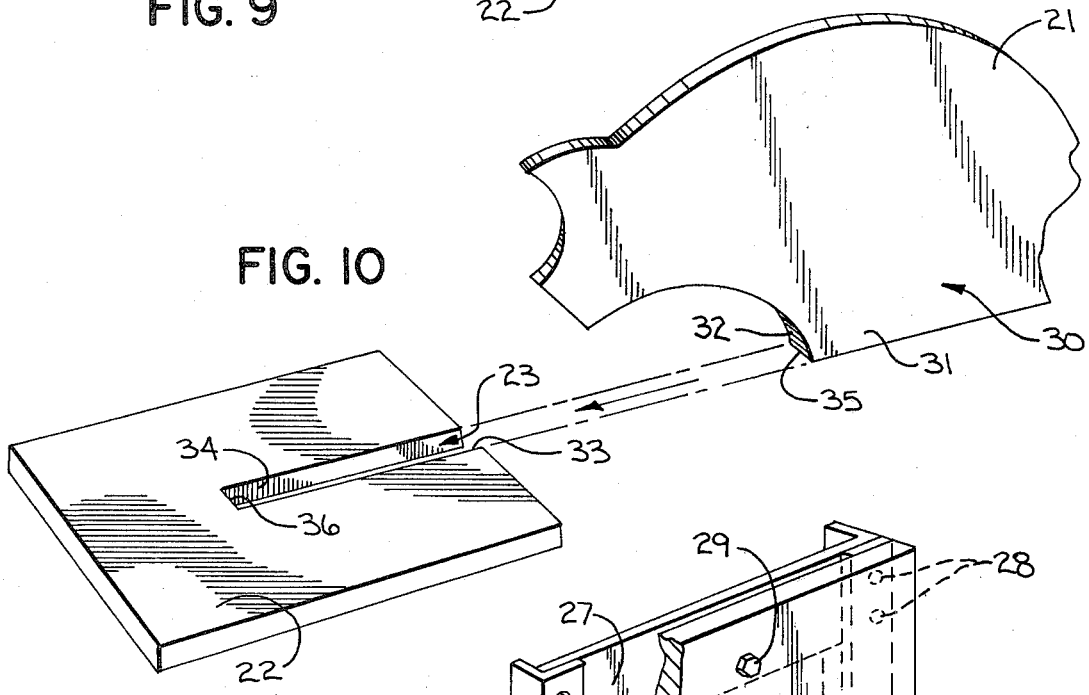
FIG. 10 is an exploded view showing the manner of assembling the silhouette and platform shown in FIG. 6.

FIG. 9 shows another target assembly which includes a silhoutte 21 and a platform or base 22. As shown, both the silhoutte 21 and platform 22 are flat and preferably cut from a flat side of a convolutely wound tubular structure. The silhoutte 21 shown in FIGS. 9 and 10 is in the outline of a pig. However, the silhoutte 21 may take a variety of different shapes and sizes.

Figure 11:
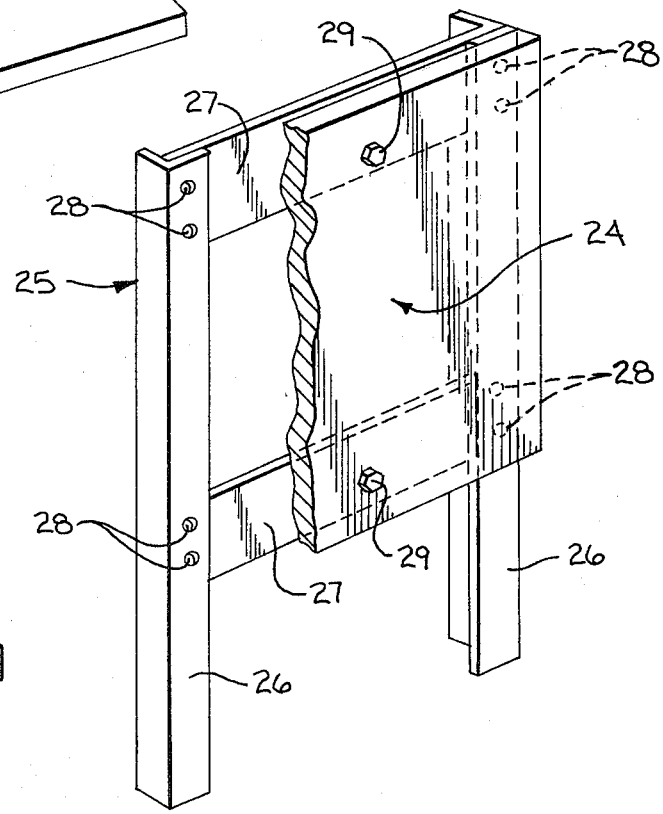
FIG. 11 is a perspective view with parts broken away of a target and upstanding frame structure constituting another form of a target assembly.

The platform 22 includes a slot 23 formed therein for retaining the silhoutte 21 in an upstanding position. As shown in FIG. 10, the silhoutte 21 may be assembled with the platform 22 by simply sliding its lower portion into slot 23. In this regard, the lower portion 30 includes a projection having oppositely disposed side edges 31 and 32 which slidingly engage opositely spaced side edges 33 and 34 of slot 23, respectively. When fully assembled, a stop 35 joining the side edges 31 and 32 engages an abutment 36 joining the side edges 33 and 34. The width of slot 23 substantially corresponds to the width of silhoutte 21 thereby permitting the platform to support silhoutte 21 in an upstanding position substantially perpendicular thereto. FIG. 11 shows a flat target 24 mounted to a supporting frame structure 25, both of which are composed of the multi-ply paper laminate member 3. The supporting frame 25 includes a pair of upstanding spaced apart elongate support members 26, and a pair of cross members 27 interconnecting the support members 26. The support members 26 are L-shaped with one cross member 27 secured by bolts 28 to the top of members 26 and the other cross member 27 secured by bolts 28 at the approximate mid-point of each member 26. As shown in FIG. 11, the target 24 is mounted on frame 25 to the cross members 27 by a plurality of bolts 29 which extend through the cross members 27. A target assembly utilizing the frame 25 shown in FIG. 11 is designed to be fixed in place and thus its thickness is preferably greater than the thicknesses of the legs 13 and 14 or 19 and 20 of the previously described target assemblies.

The target member 3 may advantageously be used for targets and supporting structures for targets. The target member 3 includes a multiplicity of plies of paper materials adhesively bonded together into a rigid laminate construction that will not ricochet a bullet and will not shatter or splinter upon bullet impact.

Various modes of carrying out the invention are contemplated as being within the scope of the following claims particularly pointing out and distinctly claiming the subject matter which is regarded as the invention.

I claim:

1. A target comprising a multiplicity of plies of sheet-like paper adhesively bonded together into a substantially non-shattering and non-splintering rigid laminate shaped to form a predetermined target face, each of said paper plies has a density of from about 3.0 to about 3.5 pounds per point of caliper.

2. The target of claim 1, wherein each of said paper plies has a thickness ranging from about 0.025 inches to about 0.035 inches.

3. The target of claim 2, wherein each of said paper plies is composed of recycled chipboard.

4. The target of claim 3, wherein each ply is composed of recycled chipboard having a maximum moisture content of 5.5%.

5. The target of claim 4, wherein said laminate has a machine direction modulus of rupture of about 3200 pounds per square inch measured in a direction normal to the plane of one of said paper plies.

6. The target of claim 1, wherein said adhesive is polyvinyl alcohol.

7. The target of claim 1, wherein said adhesive is interposed between each of said plies.

8. A method of making a target comprising the steps of selecting a continuous web of sheet-like paper material from recycled chipboard material having a density of from about 3.0 to about 3.5 pounds per point of caliper, convolutely winding said continuous web of sheet-like paper material into a tubular structure having substantially coplanar successively outwardly extending plies of said paper material, adhesively bonding the respective plies to one another as the winding proceeds, and cutting the tubular structure to form a substantially non-shattering and non-splintering target member having a predetermined target face.

9. The method of claim 8, and including the step of selecting said web of paper material with a thickness ranging from about 0.025 inches to about 0.035 inches.

10. The method of claim 8, and including the step of subjecting the web of sheet-like paper to lengthwise tension and to thicknesswise compression as the winding proceeds.

11. The method of claim 10, and including the step of applying said adhesive between each successive ply of paper material.

12. The method of claim 8, and including the step of cutting said tubular structure into the shape of an animal silhouette.

13. A target assembly, comprising a target member and a base including at least one member for supporting the target member in a shooting position, at least one of said base and target members comprising a multiplicity of substantially coplanar plies of paper sheets adhesively bonded together into a rigid laminate wherein each of said plies is composed of recycled chipboard having a thickness ranging from about 0.025 inches to about 0.035 inches and said recycled chipboard has a density of from about 3.0 to about 3.5 pounds per point of caliper.

14. The target assembly of claim 13, wherein at least one of said base and target members is cut from a convolutely wound tubular structure.

15. The target assembly of claim 13, wherein said base member is in the form of a platform having a slot therein to retain the target edgewise in an upstanding shooting position.

16. The target assembly of claim 13, wherein said base includes at least two legs each having an upwardly directed slot formed therein for receiving and retaining the target member therebetween.

17. The target assembly of claim 16, wherein said base includes a pair of legs, one of said legs including an upwardly directed notch formed therein and the other of said legs including a corresponding downwardly directed notch formed therein which enable said legs to stand in telescoping relation to one another to form a cross-shaped support.

18. The target assembly of claim 13, wherein said base includes a frame-like support formed from said rigid laminate and including a pair of upstanding spaced apart elongate support members, and at least one cross member interconnecting said support members.

19. The target assembly of claim 13, wherein both said target and said base are composed of said rigid laminate.

20. A substantially non-shattering, non-splintering and non-ricocheting target assembly, comprising a substantially flat base of convolutely wound, substantially coplanar paper plies adhesively bonded into a substantially rigid laminate having an upwardly directed face including a slot separating a pair of spaced side edges, and a silhouette of convolutely wound, substantially coplanar paper plies adhesively bonded into a substantially rigid laminate having a top portion forming a predetermined target shape and a bottom portion including a supporting projection to be removably retained within said base slot and having first and second oppositely spaced side edges to be removably engaged by said first and second base side edges, respectively, to provide upstanding support of said silhouette by said base.

21. The target of claim 20, wherein said first and second spaced base side edges are substantially parallel and joined by an abutment, said first and second silhouette side edges are substantially parallel and joined by a stop to permit sliding engagement between said first and second side edges of said base and silhouette, respectively, between a disassembled condition and an assembled condition where said abutment engages said stop.

22. A substantially non-shattering, non-splintering and non-richocheting target assembly, comprising a first base member of convolutely wound, substantially coplanar paper plies adhesively bonded into a substantially rigid laminate having a first supporting side edge and an oppositely disposed second side edge including first and second upwardly directed notches, a second base member of convolutely wound, substantially coplanar paper plies adhesively bonded into a substantially rigid laminate having a first supporting side edge including a downwardly directed notch removably retained within said first upwardly directed notch and a second oppositely spaced side edge providing a third upwardly directed notch, said first and second base members removably joined by said first upwardly directed notch and said downwardly directed notch to form an X-shaped base sub-assembly supported by said first supporting side edges, and a target of convolutely wound, substantially coplanar paper plies adhesively bonded into a substantially rigid laminate forming a predetermined target shape and having a supporting side edge removably engaged within said second and third upwardly directed notches to provide upstanding support for said target while permitting ready disassembly and re-assembly for replacing a worn-out target and transporting said target assembly.

23. The target assembly of claim 22, wherein said target includes a first concave surface and an oppositely disposed convex surface, said second and third upwardly directed notches releasably engaging said target to permit the selective positioning of said concave and convex surfaces to face said firing direction with said convex surface directed toward the wind to provide a sturdy target assembly without changing the firing direction.

24. The target assembly of claim 22, wherein said first and second base members each have a slight curvature to stabilize said target assembly.

25. A substantially non-shattering, non-splintering and non-richocheting target assembly, comprising a first U-shaped base member of convolutely wound, substantially co-planar paper plies adhesively bonded into a substantially rigid laminate having a first supporting side edge and a second oppositely spaced side edge providing a first upwardly directed notch, a second U-shaped base member of convolutely wound, substantially co-planar paper plies adhesively bonded into a substantially rigid laminate having a first supporting side edge and a second oppositely spaced side edge providing a second upwardly directed notch, and a U-shaped target of convolutely wound, substantially co-planar paper plies adhesively bonded into a substantially rigid laminate including a base portion providing a target face and first and second spaced leg portions vertically extending along said target face, a side edge of said U-shaped target removably retained within said first and second upwardly directed notches to provide upstanding support for said target while permitting ready disassembly and re-assembly for replacing a worn-out target and transporting said target assembly.

26. The target assembly of claim 25, wherein said first and second upwardly directed notches engage said target side edge at first and second spaced junctions, respectively, of said base portion and said first and second leg portions, respectively.

27. A substantially non-shattering, non-splintering and non-ricocheting target assembly, comprising first and second spaced vertically extending L-shaped fixed supports each of convolutely wound, substantially co-planar paper plies adhesively bonded into a substantially rigid laminate, first and second vertically spaced struts connecting said first and second fixed supports with each strut of convolutely wound, substantially coplanar paper plies adhesively bonded into a substantially rigid laminate to provide a supporting subassembly, and a target of convolutely wound, substantially co-planar paper plies adhesively bonded into a substantially rigid laminate connected to said subassembly to provide a substantially fixed target assembly formed substantially of paper.

28. A target comprising a multiplicity of plies of sheet-like paper adhesively bonded together into a substantially non-shattering and non-splintering rigid laminate shaped to form a predetermined target face wherein each of said paper plies has a thickness ranging from about 0.025 inches to about 0.035 inches and is composed of recycled chipboard.

29. The target of claim 28, wherein each ply is composed of recycled chipboard having a maximum moisture content of 5.5%.

30. The target of claim 29, wherein said laminate has a machine direction modulus of rupture of about 3200 pounds per square inch meansured in a direction normal to the plane of one of said paper plies.

31. The target of claim 28, wherein said laminate has a density of from about 3.0 to about 3.5 pounds per point of caliper.

* * * * *